US007481628B2

(12) United States Patent
Yamamoto et al.

(10) Patent No.: US 7,481,628 B2
(45) Date of Patent: Jan. 27, 2009

(54) DIAPHRAGM PUMP

(75) Inventors: Shinya Yamamoto, Kariya (JP); Makoto Yoshikawa, Kariya (JP); Takao Mishina, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 333 days.

(21) Appl. No.: 11/363,335

(22) Filed: Feb. 27, 2006

(65) Prior Publication Data

US 2006/0198740 A1 Sep. 7, 2006

(30) Foreign Application Priority Data

Mar. 1, 2005 (JP) ..... 2005-055239

(51) Int. Cl.
*F04B 25/00* (2006.01)

(52) U.S. Cl. ..... 417/244; 417/250; 417/253; 417/413.1; 417/440; 92/96; 92/97

(58) Field of Classification Search ..... 417/569, 417/395, 392, 283, 285, 297, 301, 307, 522, 417/244, 250, 253, 413.1, 440; 60/564, 579; 239/330; 251/57; 92/96, 97
See application file for complete search history.

(56) References Cited

U.S. PATENT DOCUMENTS 3,765,802 A * 10/1973 Leitermann et al. ..... 417/395
4,640,097 A * 2/1987 Kobayashi ..... 60/554
5,437,218 A * 8/1995 Papin ..... 92/13.2
5,438,913 A * 8/1995 Budde ..... 92/98 R
2004/0136843 A1 * 7/2004 Jahn et al. ..... 417/395

FOREIGN PATENT DOCUMENTS

| | | |
|---|---|---|
| DE | H0012805 Z | 7/1956 |
| FR | 1221835 A | 3/1960 |
| JP | 53-41803 | 4/1978 |
| JP | 2000-136775 | 5/2000 |

OTHER PUBLICATIONS

Machine translated Dragenwerk DE H 0012805 AZ.*
Machine translated Burton FR 1221835 A.*
DE Office Action dated May 23, 2007. [English Translation].

* cited by examiner

*Primary Examiner*—Devon C Kramer
*Assistant Examiner*—Christopher Bobish
(74) *Attorney, Agent, or Firm*—Knoble Yoshida & Dunleavy, LLC

(57) ABSTRACT

A diaphragm pump for pumping a fluid includes a housing, a pump chamber defined in the housing, a first diaphragm for sealing the pump chamber, a pressure control chamber defined in the housing adjacent to the pump chamber via the first diaphragm, a second diaphragm for sealing the pressure control chamber, a drive mechanism operable to deform the first and second diaphragms, an introduction passage for introducing into the pressure control chamber a part of the fluid that is discharged from the pump chamber, and a pressure regulating valve disposed in the introduction passage for adjusting a pressure in the pressure control chamber to a medium pressure between a suction pressure and a discharge pressure.

9 Claims, 3 Drawing Sheets

DIAPHRAGM PUMP

BACKGROUND OF THE INVENTION

The present invention relates to a diaphragm pump that includes a plurality of diaphragms in a housing.

A diaphragm pump generally includes a diaphragm for defining a pump chamber in a housing and a drive mechanism for deforming the diaphragm thereby to vary the volume of the pump chamber. According to the variation of the volume of the pump chamber, the pump performs a pumping action, drawing therein and discharging therefrom a fluid. In a diaphragm pump with a mechanical drive mechanism (a mechanical type diaphragm pump), when the difference between the pressure in the pump chamber and the atmospheric pressure is increased, the diaphragm may be damaged due to the increased pressure difference. Thus, it is difficult to set the discharge pressure of the mechanical type diaphragm pump at a high pressure value.

According to prior art disclosed in Japanese Patent Application Publication No. 53-41803, the discharge pressure of the mechanical type diaphragm pump is set at a high pressure value. More specifically, a plurality of pumps is provided, and the fluid discharged from the former pump is drawn into the subsequent pump, thereby raising the pressure of the discharged fluid in stages. As a result, a desired high pressure in the fluid discharged from the last pump is obtained. In this prior art, in order to suppress the pressure difference that is applied to the diaphragm, a sealed chamber is provided for accommodating each diaphragm pump, and the fluid subjected to pressurization is made to stay in the sealed chamber and then is drawn into the pump.

As to another prior art, the diaphragm pump disclosed in Japanese Patent Application Publication No. 2000-136775 is known. The diaphragm pump includes two diaphragms. A pressure chamber (or a pump chamber) is defined in the housing by one of the diaphragms, and a pressure control chamber is defined between both of the diaphragms. A passage is provided for connecting the pressure chamber to the pressure control chamber, and a check valve is disposed in this passage. According to this prior art, the reversal of the diaphragm is prevented during operation of the pump by constantly adjusting the pressure in the pressure control chamber to the negative or positive pressure with respect to the pressure in the pressure chamber.

In the art of Japanese Patent Application Publication No. 53-41803, the back pressure on the diaphragm correspond to the discharge pressure of the former diaphragm pump. When the difference between the discharge pressure and the suction pressure (or the discharge pressure of the former diaphragm pump) is great, the diaphragm may be damaged due to the great pressure difference. In the diaphragm pump of such type, therefore, a compression rate needs to be set based on the suction pressure (or the discharge pressure of the former diaphragm pump). Since the fluid discharged from the former diaphragm pump is drawn into the subsequent diaphragm pump, the discharge pressure of the subsequent diaphragm pump may be insufficient depending on timing of operation of the former diaphragm pump.

In the art of Japanese Patent Application Publication No. 2000-136775, two diaphragms are provided in the housing of the pump. When the pressure in the pressure control chamber is adjusted to the positive pressure with respect to the pressure in the pressure chamber, the fluid in the pressure chamber having the discharge pressure is introduced into the pressure control chamber. The fluid having the discharge pressure which has been introduced in the pressure control chamber does not flow out therefrom due to the check valve. Thus, the pressure in the pressure control chamber is maintained at the discharge pressure. This creates a resistance against the deformation of the diaphragm so that there is a fear that the fluid may be prevented from being drawn into the pressure chamber. In this regard, the pressure in the pressure control chamber is substantially the same as that in the pressure chamber when the pump discharges therefrom the fluid, so that no pressure difference is applied to the diaphragm. However, when the pump draws therein the fluid, the difference between the pressure in the pressure control chamber and the suction pressure in the control pressure is significantly great. This great pressure difference may increase a load on the diaphragm adjacent to the pressure chamber. Japanese Patent Application Publication No. 2000-136775 further discloses an embodiment in which the pressure in the pressure control chamber is adjusted to the negative pressure with respect to the pressure in the control chamber. In this case, no fluid is introduced from the pressure chamber into the pressure control chamber due to the check valve, and the pressure in the pressure control chamber is substantially the same as the suction pressure. When the difference between the discharge pressure and the suction pressure is great, the diaphragm may be damaged due to the great pressure difference similarly to Japanese Patent Application Publication No. 53-41803.

The present invention is directed to a diaphragm pump that achieves high discharge pressure and reduces the load on the diaphragm caused by pressure difference.

SUMMARY OF THE INVENTION

A diaphragm pump for pumping a fluid includes a low pressure side pump; a high pressure side pump, the high pressure side pump and the low pressure side pump being connected to each other via a communication passage, the high pressure side pump further including a housing having an inlet to which the communication passage is connected; a pump chamber defined in the housing; a first diaphragm for sealing the pump chamber; a pressure control chamber defined in the housing adjacent to the pump chamber via the first diaphragm; a second diaphragm for sealing the pressure control chamber; a drive mechanism operable to deform the first and second diaphragms; an introduction passage for introducing into the pressure control chamber a part of the fluid that is discharged from the pump chamber; a pressure regulating valve disposed in the introduction passage for adjusting a pressure in the pressure control chamber to a medium pressure between a suction pressure of the high pressure side pump and a discharge pressure of the high pressure side pump, wherein the pressure regulating valve is only provided with the high pressure side pump; and a branch passage branching from the introduction passage at the pressure regulating valve and connecting to the communication passage, wherein the branch passage drains an extra pressure from the pressure regulating valve to the communication passage when the pressure regulating valve adjusts the pressure of the discharge fluid in the introduction passage.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
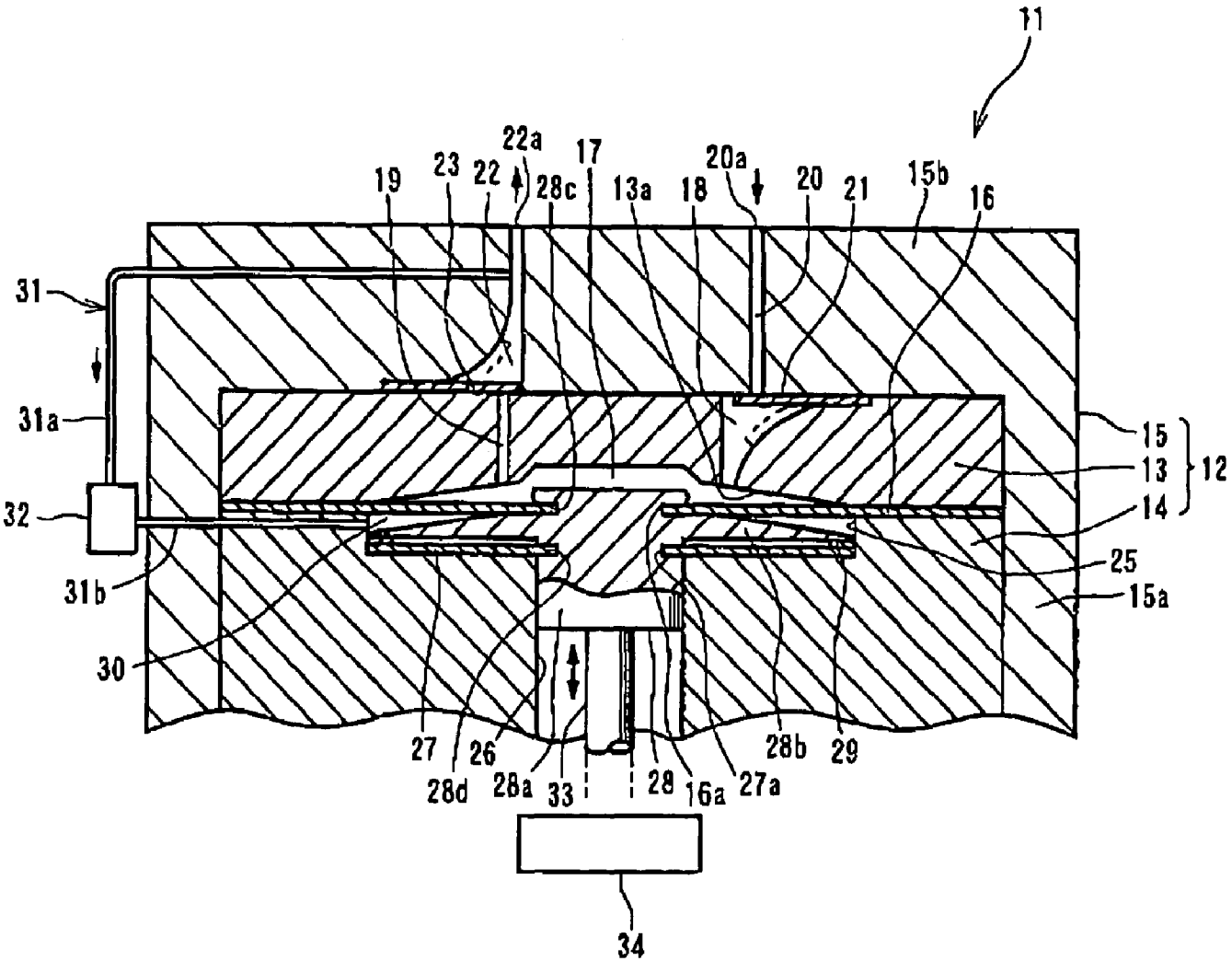
FIG. 1 is a schematic cross-sectional view of a diaphragm pump according to a first preferred embodiment of the present invention.
Figure 2A:
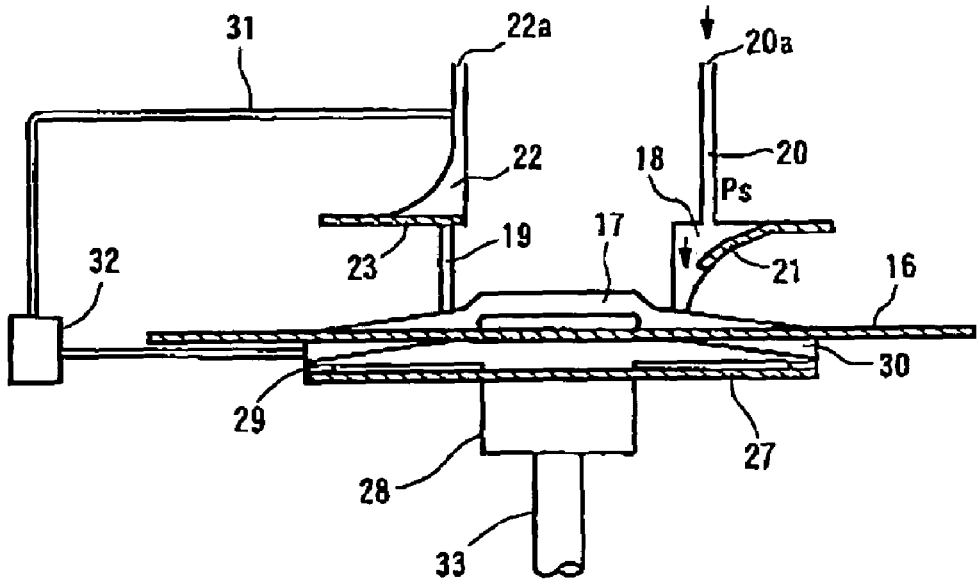
FIG. 2A is a partially schematic cross-sectional view of the diaphragm pump according to the first preferred embodiment when the volume of a pump chamber is increased.
Figure 2B:
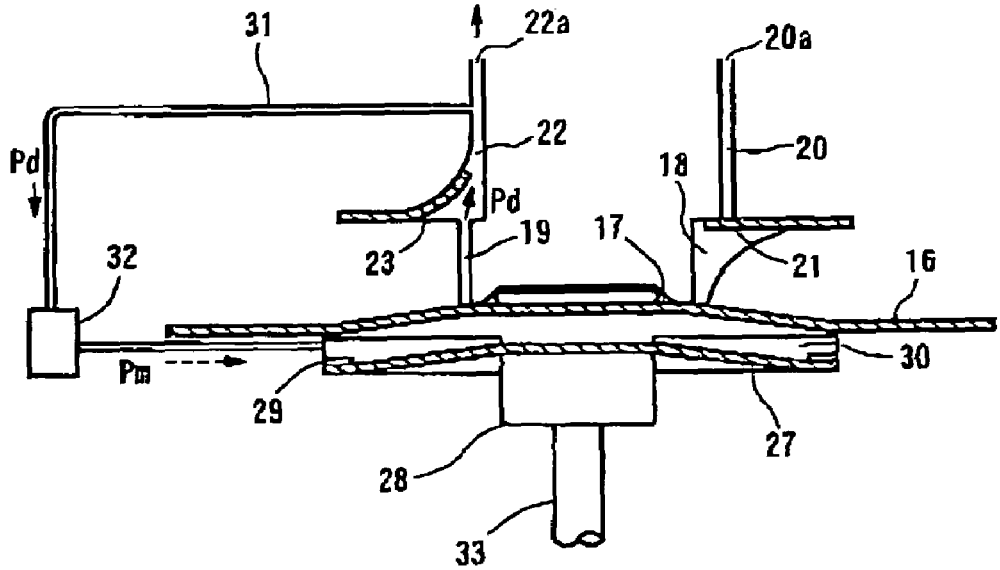
FIG. 2B is a partially schematic cross-sectional view of the diaphragm pump according to the first preferred embodiment when the volume of the pump chamber is reduced.

The following will describe the diaphragm pump of a first preferred embodiment according to the present invention with reference to FIGS. 1 through 2B. FIG. 1 shows a cross-sectional view of the diaphragm pump of the first preferred embodiment. Referring to FIG. 1, the diaphragm pump 11 (hereinafter referred to as "pump") includes a housing 12, a first diaphragm 16 and a second diaphragm 27, which are supported by the housing 12, a drive mechanism operable to displace or deform the first and second diaphragms 16 and 27, an introduction passage 31, and a pressure regulating valve 32, which is disposed in the introduction passage 31. The pump 11 performs a pumping action by deforming the first and second diaphragms 16 and 27 based on the operation of the drive mechanism.

The housing 12 includes a first housing member 13, a second housing member 14 joined to the first housing member 13, and a third housing member 15 surrounding the first and second housing members 13 and 14. The third housing member 15 is formed in substantially inverted U shape having a side wall 15*a* and an end wall 15*b*. The end wall 15*b* is joined to the first housing member 13. The first housing member 13 is located between the second housing member 14 and the end wall 15*b* of the third housing member 15. The first diaphragm 16 is interposed between the first and second housing members 13 and 14. The first diaphragm 16 is a disc-shaped, thin plate made of metal and has appropriate elasticity and flexibility. The first diaphragm 16 has a hole 16*a* at the center through which a piston 28 that the drive mechanism includes is inserted.

The first housing 13 has a recess 13*a* with a gently inclined surface. The opening end of the recess 13*a* is edged with the first diaphragm 16, thereby defining an inverted dish-shaped space or a pump chamber 17. Namely, the first diaphragm 16 serves to seal the pump chamber 17. The first housing 13 has a suction port 18 and a discharge port 19, which lead to the pump chamber 17.

The end wall 15*b* of the third housing 15 has a suction passage 20 that is connected to the suction port 18. A suction valve 21 or a reed valve is provided between the suction port 18 and the suction passage 20. The fixed end of the suction valve 21 is supported by sandwiching between the first and third housing members 13 and 15. The suction valve 21 serves as a check vale to open during a suction stroke of the pump 11 for allowing fluid to flow from the suction passage 20 into the suction port 18. The end wall 15*b* of the third housing member 15 has a discharge passage 22 that is connected to the discharge port 19. A discharge valve 23 or a reed valve is provided between the discharge port 19 and the discharge passage 22. The fixed end of the discharge valve 23 is supported by sandwiching between the first and third housing members 13 and 15. The discharge valve 23 serves as a check vale to open during a discharge stroke of the pump 11 for allowing fluid to flow from the discharge port 19 into the discharge passage 22. The inlet 20*a* of the suction passage 20 is connected to a low-pressure external pipe (not shown), and the outlet 22*a* of the discharge passage 22 is connected to a high-pressure external pipe (not shown).

The second housing 14 has a recess 25 on the end surface thereof adjacent to the first diaphragm 16. The recess 25 is formed at a certain depth. The recess 25 is ring- or circular-shaped, and the inner diameter of the recess 25 substantially corresponds to that of the opening of the recess 13*a* adjacent to the first diaphragm 16. The second housing member 14 has a cylindrical hole 26 at the center thereof, which is connected to the recess 25 and extends perpendicular to the first diaphragm 16. The axis of the cylindrical hole 26 coincides with that of the recess 25. The second diaphragm 27 is provided at the bottom of the recess 25 adjacent to the cylindrical hole 26. The outer diameter of the second diaphragm 27 substantially corresponds to the outer diameter of the recess 25.

The second diaphragm 27 is a disc-shaped, thin plate made of metal and has appropriate elasticity and flexibility. The second diaphragm 27 has a hole 27*a* at the center through which the piston 28 of the drive mechanism is inserted. The second diaphragm 27 is pressed at the outer periphery against the second housing member 14 by an annular tension plate 29 to prevent the second diaphragm 27 from moving away from the second housing member 14. The opening of the recess 25 adjacent to the cylindrical hole 26 is covered with the piston 28 and the second diaphragm 27, thereby defining a sealed space or a pressure control chamber 30 in the second housing member 14. The second diaphragm 27 serves to seal the pressure control chamber 30 defined in the housing 12 adjacent to the pump chamber 17 via the first diaphragm 16.

The pressure control chamber 30 is connected to the introduction passage 31, which is in turn connected to the discharge passage 22 in the third housing member 15. The pressure regulating valve 32 serves to adjust the pressure of the discharge fluid introduced from the discharge passage 22, more specifically to reduce it to a certain pressure within a constant range. Namely, a part of the fluid discharged from the pump chamber 17 is introduced into the pressure regulating valve 32 where the pressure of the fluid is reduced, and the fluid having the reduced pressure is further introduced into the pressure control chamber 30 via an introduction passage 31*b*. The pressure control chamber 30 is provided for suppressing or adjusting pressure difference applied to each of the first and second diaphragms 16 and 27 by adjusting the pressure thereon. More specifically, the pressure difference applied to the first diaphragm 16 is intended to be reduced or the load caused by the pressure difference is intended to be prevented from occurring on the first diaphragm 16.

The following will describe the drive mechanism. The drive mechanism includes the piston 28 that slides in the cylindrical hole 26, a rod 33 connected to the piston 28, and a drive source 34 that reciprocates the piston 28 through the rod 33. The piston 28 has a cylinder portion 28*a* that is disposed in the cylindrical hole 26 and a flange portion 28*b* that is disposed in the recess 25 or the pressure control chamber 30. The cylinder portion 28*a* is guided by the cylindrical hole 26 while sliding therein. Namely, the piston 28 reciprocates in its axial direction, moving toward and away from the first housing member 13. The cylinder portion 28*a* has a cut groove 28*d* at the outer circumferential surface thereof in which the second diaphragm 27 is fixedly inserted.

The outer diameter of the flange portion 28*b* substantially corresponds to the outer diameter of the pressure control chamber 30. The flange portion 28*b* has a gently inclined surface, which corresponds or substantially parallel to the gently inclined surface of the recess 13*a*, facing toward the first diaphragm 16. The cylinder portion 28*a* has a cut groove 28*c* at the outer circumferential surface thereof in which the first diaphragm 16 is fixedly inserted. As shown in FIG. 1, the top end of the cylinder portion 28*a* is disposed in the pump chamber 17. The drive source 34 is, more specifically, an electric motor, which is connected to the rod 33 through a conversion mechanism (not shown) that functions to convert the rotation of the electric motor into the reciprocating movement of the piston 28.

The following will describe the operation of the pump 11 of the first preferred embodiment. As the piston 28 reciprocates according to the drive of the drive source 34, the first and second diaphragms 16 and 27, which are fixed to the piston 28, are deformed. In accordance with the deformation of the first diaphragm 16, the volume of the pump chamber 17 is varied. More specifically, when the piston 28 moves away from the first housing member 13, the first diaphragm 16 increases the volume of the pump chamber 17 as shown in FIG. 2A. Due to the increase in the volume of the pump chamber 17, the suction valve 21 opens and the low pressure fluid is drawn into the pump chamber 17 through the suction passage 20 and the suction port 18. Most of the lower surface of the second diaphragm 27 comes into contact with the second housing member 14 when the piston 28 is displaced away from the first housing member 13. The volume of the pressure control chamber 30 after this deformation of the second diaphragm 27 is substantially the same as that before the deformation because the first diaphragm 16 is deformed simultaneously with the second diaphragm 27.

On the other hand, when the piston 28 moves toward the first housing member 13, the first diaphragm 16 reduces the volume of the pump chamber 17 as shown in FIG. 2B. Due to the reduction in the volume of the pump chamber 17, the pressure in the pump chamber 17 reaches a certain pressure to open the discharge valve 23, thereby discharging the fluid therefrom through the discharge port 19 and the discharge passage 22. According to this displacement of the piston 28, the second diaphragm 27 is deformed so that a large part of the second diaphragm 27 is separated from the second housing member 14.

Meanwhile, a part of the fluid that has been discharged from the pump chamber 17 flows toward the pressure control chamber 30 through the introduction passage 31. The high-pressure discharge fluid in the introduction passage 31 is reduced in pressure by the pressure regulating valve 32. More specifically, the pressure of the discharge fluid is reduced to a pressure Pm that is substantially a medium pressure between the suction pressure Ps and the discharge pressure Pd (hereinafter referred to as "medium pressure Pm"). During the suction stroke of the pump 11, the pressure difference applied to the first diaphragm 16 corresponds to the pressure difference between the medium pressure Pm and the suction pressure Ps. During the discharge stroke of the pump 11, the pressure difference applied to the first diaphragm 16 corresponds to the pressure difference between the discharge pressure Pd and the medium pressure Pm.

The pressure in the pressure control chamber 30 is maintained approximately at the medium pressure Pm, thereby suppressing the pressure difference applied to the first diaphragm 16. Thus, the load on the first diaphragm 16 caused by the pressure difference is reduced in comparison with the diaphragms of conventional diaphragm pumps to which the pressure difference between the discharge pressure and the atmospheric pressure is applied. Since the medium pressure Pm is maintained at a certain pressure within a constant range during the suction stroke and the discharge stroke of the pump 11, the pressure difference applied to the second diaphragm 27 corresponds to the pressure difference between the medium pressure Pm and the atmospheric pressure Pa. In comparison with the case where the discharge fluid having the discharge pressure is directly introduced into the pressure control chamber 30, the pressure difference applied to the second diaphragm 27 is suppressed by maintaining the medium pressure Pm in the pressure control chamber 30 so that the pressure difference between the discharge pressure Pd and the atmospheric pressure Pa is applied to the second diaphragm 27.

According to the pump 11 of the first preferred embodiment, the following advantageous effects are obtained.

(1-1) The pressure of the discharge fluid that is introduced into the pressure control chamber 30 through the pressure regulating valve 32 is adjusted to the medium pressure Pm thereby suppressing the pressure difference applied to each of the first and second diaphragms 16 and 27. Accordingly, the pump 11 solely reduces the pressure difference applied to each of the first and second diaphragms 16 and 27 as well as provides higher discharge pressure.

(1-2) To change the setting of the pressure regulating valve 32 in the introduction passage 31 makes it possible to optionally vary the pressure in the pressure control chamber 30. For example, the pressure in the pressure control chamber 30 is varied in response to the change of several operational conditions of the pump 11.

(1-3) By varying the pressure in the pressure control chamber 30, the pressure difference between the pump chamber 17 and the pressure control chamber 30, which is applied to the first diaphragm 16, is at least suppressed, or furthermore substantially cancelled. Depending on the setting of the pressure in the pressure control chamber 30 by the pressure regulating valve 32, an amount of fluid compressed by the diaphragm 16 can be increased, thereby obtaining high discharge pressure with the sole pump and reducing or canceling the load on each of the first and second diaphragms 16 and 27.

Figure 3:
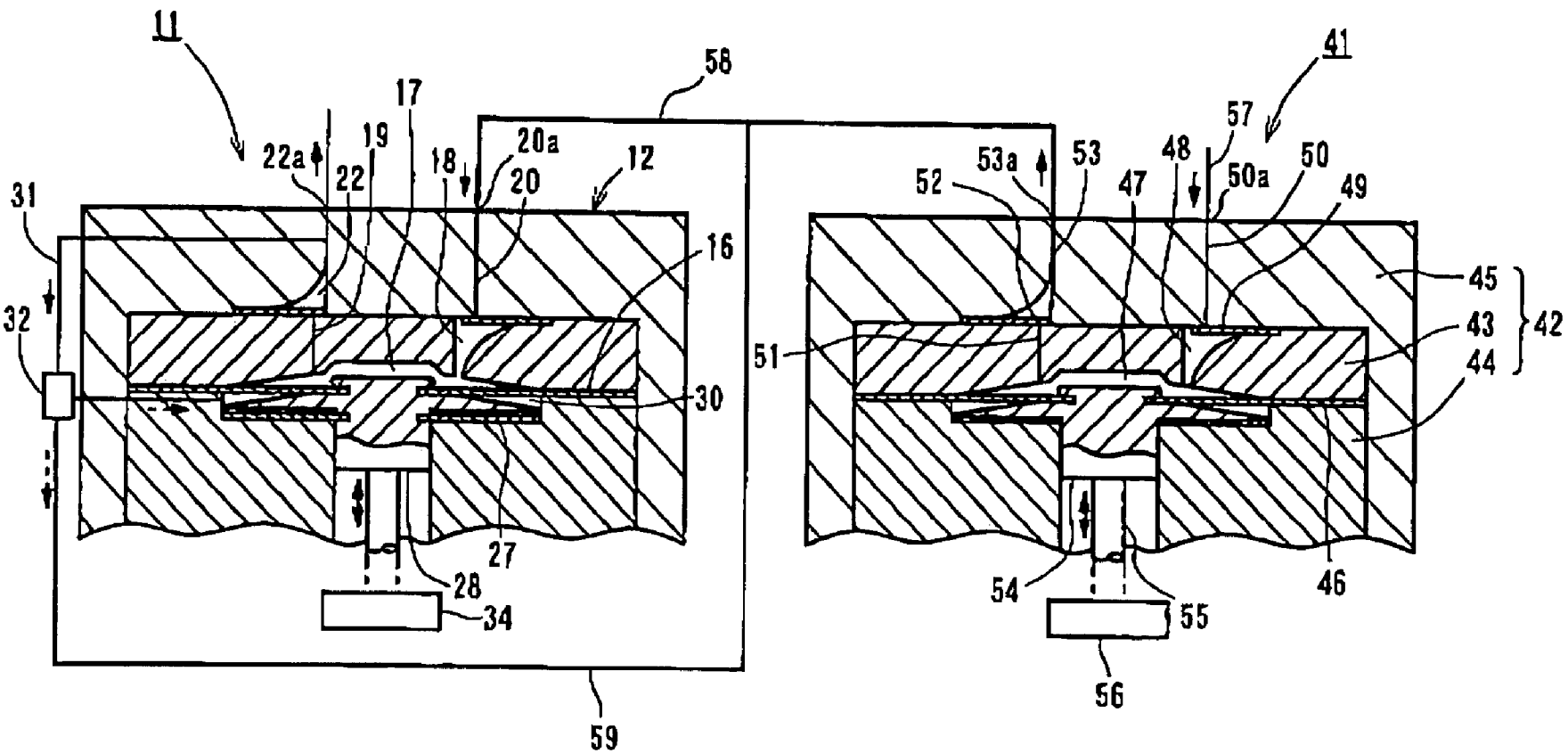
FIG. 3 is a schematic cross-sectional view of a diaphragm pump according to a second preferred embodiment of the present invention, which is connected to another diaphragm pump.

The following will describe a second preferred embodiment with reference to FIG. 3. Referring to FIG. 3, the pump 11 of the first preferred embodiment is connected to a diaphragm pump 41 as a second diaphragm pump. In the second preferred embodiment, high-pressure discharge fluid is intended to gain by using the two pumps 11 and 41. Like or same elements are referred to by the same reference numerals as those which have been used in the first preferred embodiment, and the description thereof is not reiterated.

Still referring to FIG. 3, the pump 41 includes a housing 42 including first through third housing members 43 through 45 similarly to the pump 11. A diaphragm 46 is interposed between the first and second housing members 43 and 44. For convenient of explanation, the pumps 41 and 11 are referred to as "low pressure side pump 41" and "high pressure side pump 11", respectively. Similarly to the high pressure side pump 11, the low pressure side pump 41 includes a pressure chamber 47, a suction port 48, a suction valve 49, a suction passage 50, a discharge port 51, a discharge valve 52 and a discharge passage 53. The low pressure side pump 41 further includes a piston 54 for deforming the diaphragm 46 and a drive source 56 connected to the piston 54 through a rod 55. The low pressure side pump 41 differs from the high pressure side pump 11 in that the pressure control chamber 30 is not provided. Thus, the diaphragm 46 receives the pressure different between the discharge pressure and the atmospheric pressure on a side of the piston 54 and performs substantially the same function as conventional diaphragm pumps.

The suction passage 50 of the low pressure side pump 41 has an inlet 50*a* that is connected to a low-pressure external pipe 57. The discharge passage 53 of the low pressure side pump 41 has an outlet 53*a* that is connected to the inlet 20*a* of the high pressure side pump 11 through a communication passage 58. The communication passage 58 is a passage for supplying the high pressure side pump 11 with the discharge fluid discharged from the low pressure side pump 41 as a suction fluid. A branch passage 59 connects the communication passage 58 to the pressure regulating valve 32. The branch passage 59 serves to receive an extra pressure from the pressure regulating valve 32 when adjusting the pressure of the discharge fluid in the introduction passage 31.

In the second preferred embodiment, the low pressure side pump 41 is connected to the high pressure side pump 11, and the discharge fluid from the low pressure side pump 41 is drawn into the high pressure side pump 11 as a suction fluid. By the pumping action of the high pressure side pump 11, higher-pressure discharge fluid is discharged therefrom. The pressure of the discharge fluid flowing in the introduction passage 31 is adjusted by the pressure regulating valve 32 to the medium pressure Pm between the suction pressure and the discharge pressure. The extra pressure, when the pressure of the discharge pressure in the introduction passage 31 is adjusted by the pressure regulating valve 32, is released to the branch passage 59. Thus, the extra fluid remains in the passage 31 or 59 and does not flow out to the outside. By maintaining the medium pressure Pm in the pressure control chamber 30, the pressure difference applied to each of the first and second diaphragms 16 and 27 is suppressed.

According to the second preferred embodiment, the following effects are obtained.

(2-1) The low pressure side pump 41 is connected to the high pressure side pump 11, and the discharge fluid from the low pressure side pump 41 is drawn into the high pressure side pump 11 and discharged therefrom. Thus, higher-pressure discharge fluid is obtained. The pressure in the pressure control chamber 30 is maintained at the medium pressure Pm, thereby suppressing the pressure difference applied to each of the first and second diaphragms 16 and 27 of the high pressure side pump 11.

(2-2) When the pressure of the discharge fluid in the introduction passage 31 is adjusted by the pressure regulating valve 32, a part of the discharge fluid in the introduction passage 31 is released from the pressure regulating valve 32 to the branch passage 59. Thus, the fluid that has been subjected to pressure adjustment remains in the passage 31 or 59 and does not flow out to the outside.

The above-described first and second preferred embodiments are merely examples of the present invention and may be modified without departing from the purpose of the invention. The following alternative embodiments are also practicable.

The diaphragm pump with the two diaphragms is illustrated in the above-described first and second embodiments. The number of diaphragms are not limited to two as long as two or more of diaphragms are provided. For example, three diaphragms are provided in a pump. In this case, a plurality of pressure control chambers are provided. This is advantageous for further reducing the pressure difference applied to each diaphragm.

The introduction passage is provided for branching from the discharge passage in the above-described first and second preferred embodiments. Alternatively, the introduction passage may be connected to the pump chamber.

In the above-described second preferred embodiment, the diaphragm pump with the single diaphragm is provided as the low pressure side diaphragm pump. The type of the low pressure side diaphragm pump is not limited thereto. For example, the diaphragm pump that is similar in structure as the high pressure side diaphragm pump may be used as the low pressure side diaphragm pump.

In the above-described second preferred embodiment, the branch passage is connected to the pressure regulating valve. Alternatively, the branch passage branching from the communication passage is optionally connected to the pressure control chamber, and another pressure regulating valve is provided in the branch passage.

In the above-described second preferred embodiment, the low pressure side diaphragm pump and the high pressure side diaphragm pump are connected to each other. Alternatively, another diaphragm pump may be connected to the high pressure side diaphragm pump. Namely, three diaphragm pumps are connected to each other in series for obtaining high pressure discharge fluid.

The fluid in the above-described first and second preferred embodiments may be gas or liquid, and a type thereof is not limited.

The present examples and embodiments are to be considered as illustrative and not restrictive, and the invention is not to be limited to the details given herein but may be modified within the scope of the appended claims.

What is claimed is:

1. A diaphragm pump system for pumping a fluid, comprising:

a low pressure side pump;

a high pressure side pump, the high pressure side pump and the low pressure side pump being connected to each other via a communication passage, the high pressure side pump further including;

a housing having an inlet to which the communication passage is connected;

a pump chamber defined in the housing;

a first diaphragm for sealing the pump chamber;

a pressure control chamber defined in the housing adjacent to the pump chamber via the first diaphragm;

a second diaphragm for sealing the pressure control chamber;

a drive mechanism operable to deform the first and second diaphragms;

an introduction passage for introducing into the pressure control chamber a part of the fluid that is discharged from the pump chamber;

a pressure regulating valve disposed in the introduction passage for adjusting a pressure in the pressure control chamber to a medium pressure between a suction pressure of the high pressure side pump and a discharge pressure of the high pressure side pump, wherein the pressure regulating valve is only provided with the high pressure side pump; and a branch passage branching from the introduction passage at the pressure regulating valve and connecting to the communication passage, wherein the branch passage drains an extra pressure from the pressure regulating valve to the communication passage when the pressure regulating valve adjusts the pressure of the discharge fluid in the introduction passage.

2. The diaphragm pump according to claim 1, wherein the pressure regulating valve causes the medium pressure to be within a constant range.

3. The diaphragm pump according to claim 1, wherein the housing includes first and second housing members, the first diaphragm being interposed between the first and second housing members.

4. The diaphragm pump according to claim 3, wherein the second diaphragm has an outer periphery that is pressed against the second housing member by an annular tension plate.

5. The diaphragm pump according to claim 1, wherein the drive mechanism includes a piston that is connected to the first and second diaphragms and a drive source that is connected to the piston through a rod.

6. The diaphragm pump according to claim 5, wherein the housing has a cylindrical hole that is connected to the pressure control chamber, the piston being reciprocatably slidable in the cylindrical hole.

7. The diaphragm pump according to claim 5, wherein the drive source is an electric motor.

8. The diaphragm pump according to claim 5, wherein the pressure control chamber is defined by the first and second diaphragms, the piston and the housing.

9. The diaphragm pump according to claim 1, wherein the housing has a discharge passage that is connected to the pump chamber, the introduction passage branching from the discharge passage and being connected to the pressure control chamber.

* * * * *